US011132949B2

(12) United States Patent
Kim et al.

(10) Patent No.: US 11,132,949 B2
(45) Date of Patent: Sep. 28, 2021

(54) COMPENSATION METHOD OF DISPLAY DEVICE

(71) Applicant: SAMSUNG DISPLAY CO., LTD., Yongin-si (KR)

(72) Inventors: Kyun Ho Kim, Yongin-si (KR); Jung Taek Kim, Yongin-si (KR); Jae Woo Ryu, Yongin-si (KR); Joon Suk Baik, Yongin-si (KR); Yong Jin Shin, Yongin-si (KR); Uk Jae Jang, Yongin-si (KR); Ki Hyun Pyun, Yongin-si (KR); Sang Su Han, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/983,314

(22) Filed: Aug. 3, 2020

(65) Prior Publication Data

US 2021/0201779 A1 Jul. 1, 2021

(30) Foreign Application Priority Data

Dec. 26, 2019 (KR) ..... 10-2019-0175576

(51) Int. Cl.
*G09G 3/3233* (2016.01)

(52) U.S. Cl.
CPC ... *G09G 3/3233* (2013.01); *G09G 2320/0626* (2013.01); *G09G 2340/00* (2013.01)

(58) Field of Classification Search
CPC ..... G09G 3/3233; G09G 2320/0626; G09G 2340/00
See application file for complete search history.

(56) References Cited

U.S. PATENT DOCUMENTS

| | | | | |
|---|---|---|---|---|
| 8,217,875 | B2 | 7/2012 | Park et al. | |
| 8,547,309 | B2 | 10/2013 | Byun | |
| 9,262,987 | B2 * | 2/2016 | Albrecht | G09G 5/006 |
| 2020/0143751 | A1 * | 5/2020 | Byun | G09G 3/3233 |

FOREIGN PATENT DOCUMENTS

| | | | |
|---|---|---|---|
| KR | 101051104 | B1 | 7/2011 |
| KR | 101361949 | B1 | 2/2014 |
| KR | 1020170072994 | A | 6/2017 |

* cited by examiner

*Primary Examiner* — Stacy Khoo
(74) *Attorney, Agent, or Firm* — Cantor Colburn LLP

(57) ABSTRACT

A compensation method of a display device includes: sensing a first luminance of the display device when a first pattern is displayed on the display device; calculating a luminance prediction value corresponding to a second pattern to be displayed on the display device based on the first luminance, where the second pattern is different from the first pattern; sensing a second luminance of the display device when the second pattern is displayed on the display device; adjusting a current flowing in a first power line of the display device until the second luminance reaches the luminance prediction value; and storing compensation data corresponding to an adjusted current in a lookup table when the second luminance reaches the luminance prediction value.

24 Claims, 8 Drawing Sheets

| Gray | 0 | 32 | 64 | 96 | 128 | 160 | 192 | 224 | 255 |
|---|---|---|---|---|---|---|---|---|---|
| 0 | | | | | | | | | |
| 32 | 5.2 | | | | | | | | |
| 64 | 23.9 | | | | | | | | |
| 96 | 59.3 | | | | | | | | |
| 128 | 109.8 | | | | | | | | |
| 160 | 179.3 | | | | | | | | |
| 192 | 267.8 | | | | | | | | |
| 224 | 376.2 | | | | | | | | |
| 255 | 499.5 | | | | | | | | |

| Gray | First luminance of first pattern (nit) | Luminance prediction value of second pattern (nit) | First current of first pattern (mA) | Current prediction value of second pattern (mA) | Second luminance of second pattern (nit) | Second current of second pattern (mA) | Red gray value | Green gray value | Blue gray value |
|---|---|---|---|---|---|---|---|---|---|
| 224 | 375.9 | 187.9 | 751.9 | 375.9 | 150.4 | 300.8 | 3584 | 4032 | 3360 |
| 225 | 379.6 | 189.8 | 759.3 | 379.6 | 151.9 | 303.7 | 3600 | 4050 | 3375 |
| 226 | 383.3 | 191.6 | 766.7 | 383.4 | 153.3 | 306.7 | 3616 | 4068 | 3390 |
| 247 | 466.1 | 233.0 | 932.3 | 466.1 | 186.5 | 372.9 | 3952 | 4446 | 3705 |
| 248 | 470.3 | 235.1 | 940.6 | 470.3 | 188.1 | 376.2 | [illegible] | [illegible] | [illegible] |
| 249 | 474.4 | 237.2 | 949.0 | 474.5 | 189.8 | 379.6 | 3984 | 4482 | 3735 |
| 250 | 478.6 | 239.3 | 957.4 | 478.7 | 191.5 | 382.9 | 4000 | 4500 | 3750 |
| 251 | 482.9 | 241.4 | 965.8 | 482.9 | 193.2 | 386.3 | 4016 | 4518 | 3765 |
| 252 | 487.1 | 243.5 | 974.3 | 487.2 | 194.9 | 389.7 | 4032 | 4536 | 3780 |
| 253 | 491.4 | 245.7 | 982.8 | 491.4 | 196.6 | 393.1 | 4048 | 4554 | 3795 |
| 254 | 495.6 | 247.8 | 991.4 | 495.7 | 198.3 | 396.6 | 4064 | 4572 | 3810 |
| 255 | 500.0 | 250.0 | 10000.0 | 500.0 | 200.0 | 400.0 | 4080 | 4590 | 3825 |
| 270 | | | | | | 499.5 | 4416 | 4968 | 4140 |

FIG. 10

GLT

| Gray | First luminance of first pattern (nit) | Luminance prediction value of second pattern | First current of first pattern (mA) | Current prediction value of second pattern | Second luminance of second pattern (nit) | Second current of second pattern mA) | Red gray value | Green gray value | Blue gray value |
|---|---|---|---|---|---|---|---|---|---|
| 224 | 375.9 | 187.9 | 751.9 | 375.9 | 150.4 | 300.8 | 3584 | 4032 | 3360 |
| 225 | 379.6 | 189.8 | 759.3 | 379.6 | 151.9 | 303.7 | 3600 | 4050 | 3375 |
| 226 | 383.3 | 191.6 | 766.7 | 383.4 | 153.3 | 306.7 | 3616 | 4068 | 3390 |
| 247 | 466.1 | 233.0 | 932.3 | 466.1 | 186.5 | 372.9 | 3952 | 4446 | 3705 |
| 248 | 470.3 | 235.1 | 940.6 | 470.3 | 188.1 | 376.2 | 3968 | 4464 | 3720 |
| 249 | 474.4 | 237.2 | 949.0 | 474.5 | 189.8 | 379.6 | 3984 | 4482 | 3735 |
| 250 | 478.6 | 239.3 | 957.4 | 478.7 | 191.5 | 382.9 | 4000 | 4500 | 3750 |
| 251 | 482.9 | 241.4 | 965.8 | 482.9 | 193.2 | 386.3 | 4016 | 4518 | 3765 |
| 252 | 487.1 | 243.5 | 974.3 | 487.2 | 194.9 | 389.7 | 4032 | 4536 | 3780 |
| 253 | 491.4 | 245.7 | 982.8 | 491.4 | 196.6 | 393.1 | 4048 | 4554 | 3795 |
| 254 | 495.6 | 247.8 | 991.4 | 495.7 | 198.3 | 396.6 | 4064 | 4572 | 3810 |
| 255 | 500.0 | 250.0 | 10000.0 | 500.0 | 200.0 | 400.0 | 4080 | 4590 | 3825 |
| 270 | | | | | | 499.5 | 4416 | 4968 | 4140 |

LUT3

| Gray | 0 | 32 | 64 | 96 | 128 | 160 | 192 | 224 | 255 |
|---|---|---|---|---|---|---|---|---|---|
| 0 | | | | | | | | | |
| 32 | 35 | | | | | | | | |
| 64 | 71 | | | | | | | | |
| 96 | 106 | | | | | | | | |
| 128 | 142 | | | | | | | | |
| 160 | 177 | | | | | | | | |
| 192 | 212 | | | | | | | | |
| 224 | 248 | | | | | | | | |
| 255 | 270 | | | | | | | | |

LG2

HG2

| Luminous efficiency | E11 | E12 | E13 | Eref | E21 | E22 | E23 |
|---|---|---|---|---|---|---|---|
| First data voltage | V11_1 | V12_1 | V13_1 | Vref_1 | V21_1 | V22_1 | V23_1 |
| Second data voltage | V11_2 | V12_2 | V13_2 | Vref_2 | V21_2 | V22_2 | V23_2 |
| Compensation amount | V11_3 | V12_3 | V13_3 | Vref_3 | V21_3 | V22_3 | V23_3 |

COMPENSATION METHOD OF DISPLAY DEVICE

This application claims priority to Korean Patent Application No. 10-2019-0175576, filed on Dec. 26, 2019, and all the benefits accruing therefrom under 35 U.S.C. § 119, the content of which in its entirety is herein incorporated by reference.

BACKGROUND

(a) Field

Embodiments of the invention relate to a compensation method of a display device.

(b) Description of the Related Art

Recently, various display devices with reduced weight and volume have been developed. Such display devices include a liquid crystal display, a field emission display, a plasma display panels, and an organic light emitting display.

The display device typically includes pixels defined by gate lines and data lines, a gate driver for driving the gate lines, and a data driver for driving the data lines.

The gate driver sequentially supplies a gate signal to the gate lines, and the data driver supplies a data voltage to the data lines in synchronization with the gate signal. In this case, pixels selected by the gate signal emit light with a predetermined luminance in response to the data voltage, and an image is displayed by the light emission of the pixels.

SUMMARY OF THE INVENTION

In a display device, a data voltage corresponding to the data signal should be stably supplied to the pixels within a predetermined time (for example, a period during which the gate signal is supplied) to stably display an image. However, due to an increase in resolution and an increase in size of a panel, the data voltage may not be sufficiently charged or discharged to a desired voltage (target voltage) during a period in which the gate signal is supplied.

Embodiments of the invention are directed to a compensation method of a display device to calculate compensation data for sufficiently charging or discharging a data voltage to a target voltage.

Embodiments of the invention are directed to a compensation method of a display device to calculate compensation data with respect to a highest gray (white gray) and a lowest gray (black gray).

An embodiment of the invention provides a compensation method of a display device, including: sensing a first luminance of the display device when a first pattern is displayed on the display device; calculating a luminance prediction value corresponding to a second pattern to be displayed on the display device based on the first luminance, where the second pattern is different from the first pattern; sensing a second luminance of the display device when the second pattern is displayed on the display device; adjusting a current flowing in a first power line of the display device until the second luminance reaches the luminance prediction value; and storing compensation data corresponding to an adjusted current in a lookup table when the second luminance reaches the luminance prediction value.

In an embodiment, the first luminance may be greater than the second luminance and the luminance prediction value, and the adjusting the current may include increasing the current until the second luminance reaches the luminance prediction value.

In an embodiment, the display device may include a first pixel connected to the first power line, a second power line, a first data line and a first scan line, and a second pixel connected to the first power line, the second power line, the first data line and a second scan line, the first pixel may include a first light emitting diode connected between the first power line and the second power line, the second pixel may include a second light emitting diode connected between the first power line and the second power line, the first pattern may be a pattern displayed when both the first light emitting diode and the second light emitting diode emit light, and the second pattern may be a pattern displayed when the first light emitting diode emits light and the second light emitting diode does not emit light.

In an embodiment, the first power line of the first pixel and the first power line of the second pixel may be connected to each other at a same node.

In an embodiment, when at least one of the first pattern and the second pattern is displayed, a period during which a turn-on level scan signal is supplied to the first scan line and a period during which a turn-on level scan signal are supplied to the second scan line may partially overlap each other.

In an embodiment, the first pixel may include three subpixels of different colors.

In an embodiment, a combination of light emitted from the three subpixels in the first pattern may be white light.

In an embodiment, the adjusting the current may include increasing the current by increasing a gray value for the first pixel in the second pattern until the second luminance reaches the luminance prediction value.

In an embodiment, the compensation data stored in the lookup table may be an increased gray value with respect to the first pixel.

In an embodiment, the compensation data stored in the lookup table may be a current value of the current corresponding to the increased gray value.

Another embodiment of the invention provides a compensation method of a display device, including: sensing a first current flowing in a first power line of the display device when a first pattern is displayed on the display device; calculating a current prediction value corresponding to a second pattern to be displayed on the display device based on the first current, where the second pattern is different from the first pattern; sensing a second current flowing in the first power line when the second pattern is displayed on the display device; adjusting the second current until the second current reaches the current prediction value; and storing compensation data corresponding to an adjusted second current in a lookup table when the second current reaches the current prediction value.

In an embodiment, an amount of the first current may be larger than an amount of the second current and the current prediction value; and the adjusting the second current may include increasing the second current until the second current reaches the current prediction value.

In an embodiment, the display device may include a first pixel connected to the first power line, a second power line, a first data line and a first scan line, and a second pixel connected to the first power line, the second power line, the first data line and a second scan line, the first pixel may include a first light emitting diode connected between the first power line and the second power line, the second pixel may include a second light emitting diode connected between the first power line and the second power line, the first pattern may be a pattern displayed when both the first light emitting diode and the second light emitting diode emit light, and the second pattern may be a pattern displayed when the first light emitting diode emits light and the second light emitting diode does not emit light.

In an embodiment, the first power line of the first pixel and the first power line of the second pixel may be connected to each other at a same node.

In an embodiment, when at least one of the first pattern and the second pattern is displayed, a period during which a turn-on level scan signal is supplied to the first scan line and a period during which a turn-on level scan signal are supplied to the second scan line may partially overlap each other.

In an embodiment, the first pixel may include three subpixels of different colors.

In an embodiment, a combination of light emitted from the three subpixels in the first pattern may be white light.

In an embodiment, the adjusting the second current may include increasing the second current by increasing a gray value for the first pixel in the second pattern until the second current reaches the current prediction value.

In an embodiment, the compensation data stored in the lookup table may be an increased gray value with respect to the first pixel.

In an embodiment, the compensation data stored in the lookup table may be a current value of the second current corresponding to the increased gray value.

Another embodiment of the invention provides a compensation method of a display device, including: storing first reference data voltages for pixels of a reference display device when a first pattern is displayed on the reference display device at a first luminance; storing second reference data voltages for the pixels of the reference display device when a second pattern, which is different from the first pattern, is displayed on the reference display device at a second luminance; storing first data voltages for pixels of the display device when the first pattern is displayed on the display device at the first luminance; calculating second voltages to be provided to the pixels of the display device based on a ratio of the first data voltages with respect to the first reference data voltages when the second pattern is displayed on the display device at the second luminance; and storing compensation data corresponding to the second data voltages in a lookup table.

In an embodiment, the display device may include a first pixel connected to a first power line, a second power line, a first data line, and a first scan line and a second pixel connected to the first power line, the second power line, the first data line and a second scan line, the first pixel may include a first light emitting diode connected between the first power line and the second power line, the second pixel may include a second light emitting diode connected between the first power line and the second power line; the first pattern may be a pattern displayed when both the first light emitting diode and the second light emitting diode emit light, and the second pattern may be a pattern displayed when the first light emitting diode emits light and the second light emitting diode does not emit light.

In an embodiment, the second data voltages may be calculated based on a difference value between the first reference data voltages and the second reference data voltages, and the ratio of the first data voltages with respect to the first reference data voltages.

In an embodiment, the first luminance may be greater than the second luminance, and the second reference data voltages may be greater than the first reference data voltages.

In embodiments of the invention, as described above, compensation data is calculated for sufficiently charging or discharging a data voltage to a target voltage.

In such embodiments, compensation data is calculated with respect to a highest gray (white gray) and a lowest gray (black gray).

BRIEF DESCRIPTION OF THE DRAWINGS

FIG. 10 illustrates a schematic view of a compensation method of a display device according to an alternative embodiment of the invention.

DETAILED DESCRIPTION

Figure 1:
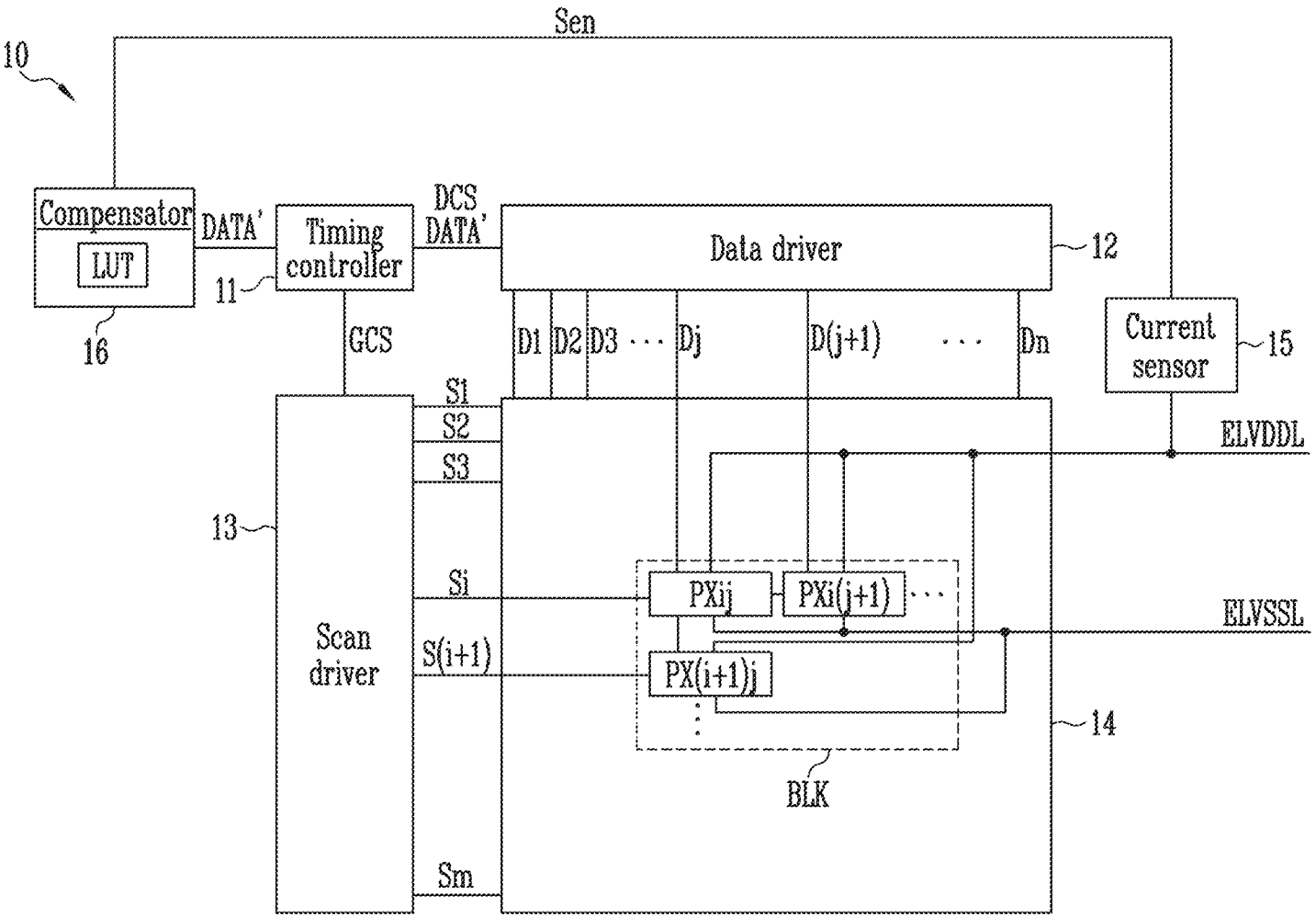
FIG. 1 illustrates a schematic view for explaining a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, embodiments of the invention will be described in detail with reference to the accompanying drawings.

Figure 2:
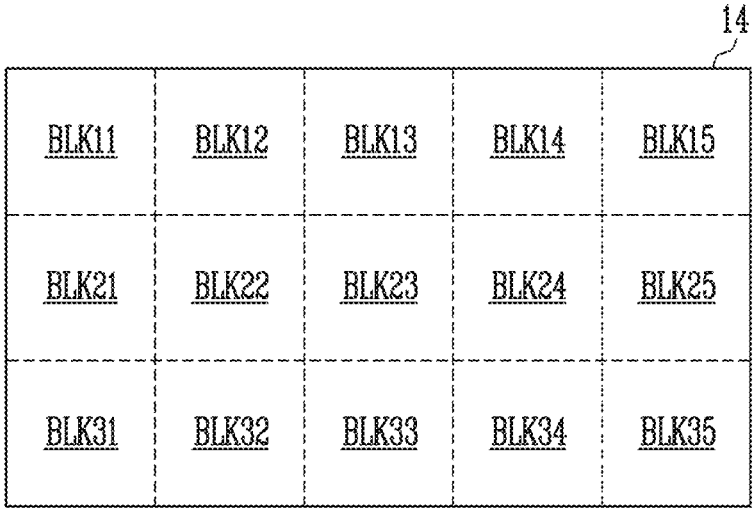
FIG. 2 illustrates a schematic view for explaining a display portion according to an embodiment of the invention.

FIG. 1 illustrates a schematic view of a display device 10 according to an embodiment of the invention, and FIG. 2 illustrates a schematic view of a display portion 14 according to an embodiment of the invention.

Referring to FIG. 1, an embodiment of the display device 10 may include a timing controller 11, a data driver 12, a scan driver 13, a display portion 14, a current sensor 15, and a compensator 16.

The timing controller 11 may receive various gray values (or gray data) and control signals for each image frame from an external processor (not shown).

The timing controller 11 may provide image data DATA', which is compensated by the compensator 16, to the data driver 12. In such an embodiment, the image data DATA' may include corrected gray values in which a source-emphasis value is reflected to original gray values for displaying an image. In such an embodiment, the image data DATA' may be image data of each of red (R), green (G), and blue (B) to be supplied to each pixel.

The timing controller 11 may render the gray values to correspond to a specification of the display device 10. In one embodiment, for example, the external processor may provide a red gray value, a green gray value, and a blue gray value for each unit dot of an image. However, if the display part 14 has a pentile structure, adjacent unit dots share pixels, so that the pixels may not correspond one-to-one with each gray value. In this case, the gray values may be rendered. In such an embodiment, if the pixels correspond one-to-one with each gray value, the gray values may not be rendered. The rendered or unrendered gray values may be provided to the data driver 12.

The timing controller 11 may provide control signals suitable for the specification of the display device 10 to the data driver 12, the scan driver 13, the current sensor 15 and the like for displaying a frame image.

The timing controller 11 may output a data control signal DCS for controlling operation timing of the data driver 12 and a gate control signal GCS for controlling operation timing of the gate driver 40.

The data driver 12 may be connected to the data lines (D1, D2, D3, Dj, D(j+1), Dn) and may generate data voltages (or data signals) to be provided to the display portion 14 through the data lines (D1, D2, D3, Dj, D(j+1), Dn) based on the gray values and the control signals (for example, the data control signal DCS). In one embodiment, for example, the data driver 12 may sample the gray values by using a clock signal, and apply data voltages corresponding to the gray values to the data lines D1 to Dn in pixel row units. Here, n may be a natural number. In such an embodiment, the data driver 12 may convert a digital image data DATA' supplied from the timing controller 11 into an analog data voltage.

The data driver 12 may supply data voltages corresponding to the image data DATA' during each horizontal period.

The scan driver 13 receives a clock signal, a scan start signal, the gate control signal GCS, and the like from the timing controller 11 to generate scan signals to be provided to scan lines (51, S2, Si, S(i+1), Sm). Here, m may be a natural number.

The scan driver 13 may sequentially supply scan signals having pulses of a turn-on level to the scan lines (51, S2, Si, S(i+1), Sm).

In an embodiment, the scan driver 13 may supply the scan signal to a current scan line during a portion of a period of supplying a previous scan line so that the data voltage is sufficiently charged to a predetermined voltage. A detailed description thereof will be given with reference to FIG. 7 and FIG. 8.

The display portion 14 may include pixels (PXij, PX(i+1)j, PXi(j+1)). Each of the pixels (PXij, PX(i+1)j, PXi(j+1)) may be connected to corresponding data and scan lines.

In one embodiment, for example, a scan transistor in the pixel PXij may be connected to an i-th scan line Si and a j-th data line Dj. The pixel PXij may be referred to as a first pixel.

In such an embodiment, a scan transistor in the pixel (PX(i+1)j) may be connected to an (i+1)-th scan line (S(i+1)) and a j-th data line Dj. The pixel (PX(i+1)j) may be referred to as a second pixel.

In such an embodiment, a scan transistor in the pixel (PXi(j+1)) may be connected to an i-th scan line (Si) and a (j+1)-th data line (D(j+1)). The pixel (PXi(j+1)) may be referred to as a third pixel.

In an embodiment, the pixels (PXij, PXi(j+1), PX(i+1)j) may be commonly connected to a first power line ELVDDL, and may be commonly connected to a second power line ELVSSL. In an alternative embodiment, the pixels (PXij, PXi(j+1), PX(i+1)j) may be commonly connected to the first power line ELVDDL and may be connected to different second power lines. In such an embodiment, the first power line ELVDDL of the pixel (for example, PXij) and the first power line ELVDDL of the pixel (for example, PXi(j+1)) may be connected to each other at a same node. According to another alternative embodiment, the pixels (PXij, PXi(j+1), PX(i+1)j) may be commonly connected to the second power line ELVSSL, and the pixels (PXij, PXi(j+1), PX(i+1)j) may be connected to different first power lines.

Referring to FIG. 2, the display portion 14 may be divided into a plurality of blocks BLK11 to BLK35. Each of the blocks BLK11 to BLK35 may be a group of pixels of a predetermined ratio among the pixels included in the display portion 14. In one embodiment, for example, the number of pixels included in one block may correspond to 1% of all the pixels included in the display portion 14. In such an embodiment, the number of blocks may be 100. However, the invention is not limited thereto, and FIG. 2 shows that the display portion 14 includes 15 blocks BLK11 to BLK35 for convenience of illustration. In one embodiment, for example, each of the blocks BLK11 to BLK35 may include at least one pixel. In one embodiment, for example, the pixels (PXij, PX(i+1)j, PXi(j+1)) may be partitioned into a specific block BLK among the plurality of blocks. The block BLK may be any one of the blocks BLK11 to BLK35 shown in FIG. 2. Hereinafter, for convenience of description, embodiments of the invention in which the block BLK23 corresponds to the block BLK shown in FIG. 1 will be described in detail.

The block BLK is a virtual element of defining a control unit for the plurality of pixels (PXij, PX(i+1)j, PXi(j+1)), and thus, it may not a physical element. The blocks BLK may be written and defined in memory before product shipment or may be actively redefined during product use. In an embodiment, each of the blocks BLK may include a same number of pixels (PXij, PX(i+1)j, PXi(j+1)), and the blocks BLK may not overlap each other. In an alternative embodiment, the blocks BLK may include different numbers of pixels (PXij, PX(i+1)j, PXi(j+1)). In another alternative embodiment, the blocks BLK may share (that is, overlap) at least some of the pixels (PXij, PX(i+1)j, PXi(j+1)).

In such an embodiment, the display portion 14 may have a constant luminous efficiency. Here, a luminous efficiency may mean a luminous intensity (unit: candela, Cd) compared to a current (unit: ampere, A) when the display portion 14 emits light at a specific brightness (for example, 500 nit). The unit of the luminous efficiency may be candela per ampere (Cd/A). Here, the current may mean a global current flowing in the first power line ELVDDL before being divided to each pixel. Here, the luminous intensity of the display portion 14 may be measured by an image sensor (not shown). Although not shown, the luminous efficiency of the display portion may be different for each display device, and the luminous efficiency of a display portion in a display device according to an embodiment of the invention and the second luminous efficiency of a display portion included in a display device according to another embodiment of the invention may be different from each other.

In an embodiment, the current sensor 15 may be connected to the first power line ELVDDL. In such an embodiment, the current sensor 15 may sense a current flowing in the first power line ELVDDL to provide the current sensing value Sen.

In an embodiment, the current sensor 15 may be connected to the common second power line ELVSSL of the pixels (PXij, PXi(j+1), PX(i+1)j). In such an embodiment, the current sensor 15 may sense a current flowing in the second power line ELVSSL to provide the current sensing value Sen.

In an embodiment, when the display device 10 displays a specific pattern by sequentially emitting light from the blocks BLK11 to BLK35, the current sensor 15 may provide the current sensing values Sen corresponding to the current flowing in the first power line ELVDDL. In such an embodiment, the current sensing values Sen may be sequentially stored. In one embodiment, for example, when the display device 10 displays a first pattern, the current sensor 15 may sense a first current to provide a first current sensing value. In such an embodiment, when the display device 10 displays a second pattern, the current sensor 15 may sense a second current to provide a second current sensing value. The first pattern and the second pattern will be described later in greater detail with reference to FIG. 7 to FIG. 9.

In such an embodiment, the current sensor 15 is connected to the common power line of all the pixels of the display portion 14, the display device 10 may include a single current sensor 15.

In an embodiment, a process of storing the current sensing values Sen may be performed once at power-on of the display device 10. In an alternative embodiment, a time point at which this process is performed may be variously set and may be performed multiple times.

The compensator 16 may be connected to the current sensor 15 and the timing controller 11. The compensator 16 may compensate image data so that an image corresponding to the image data including original gray values inputted from the outside may be properly displayed on the display portion 14, and provide the compensated image data DATA' to the timing controller 11.

The compensator 16 may compensate a gray value in a current horizontal period by comparing a gray value of a previous horizontal period and the gray value of the current horizontal period. In an embodiment, the compensator 16 may compensate the gray value in the current horizontal period by comparing the gray value in the previous horizontal period with the gray value in the current horizontal period and then obtaining compensation data corresponding to a comparison result based on a pre-stored lookup table LUT.

Here, the lookup table LUT may mean one in which compensation data corresponding to the gray value in the previous horizontal period and the gray value in the current horizontal period are stored or recorded. The compensation data included in the lookup table LUT may be experimentally or statistically determined based on a tuning result of testing the display device 10. A method of setting and recording the compensation data stored in the lookup table LUT will be described later in greater detail.

The compensator 16 may calculate a scale factor by comparing the current sensing value Sen provided from the current sensor 15 with a target current value. The compensator 16 may calculate a scale factor that causes the gray values of the pixels to be largely scaled when the current sensing value Sen is smaller than the target current value. The compensator 16 may calculate a scale factor that causes the gray values of the pixels to be small scaled when the current sensing value Sen is larger than the target current value. In addition, the compensator 16 may scale the gray values by using the calculated scale factor. The driving process described above may mean global current management (GCM).

In an embodiment, as shown in FIG. 1, the compensator 16 may exist outside of the timing controller 11. Alternatively, the compensator 16 may be included in the timing controller 11 or integrated into a single configuration or chip with the timing controller 11.

Figure 3:
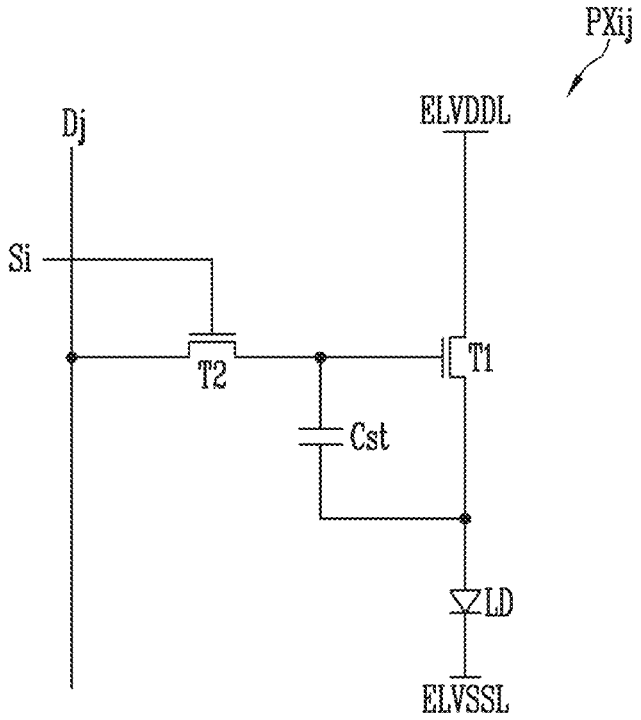
FIG. 3 illustrates an equivalent circuit diagram of a pixel according to an embodiment of the invention.

FIG. 3 illustrates an equivalent circuit diagram of a pixel according to an embodiment of the invention.

Referring to FIG. 3, the pixel PXij includes transistors T1 and T2, a storage capacitor Cst, a light emitting diode LD, and the like.

Hereinafter, for convenience of description, embodiments of the pixel PXij including a circuit configured of an N-type transistor will be described in detail. However, a person of an ordinary skilled in the art would understand such embodiments may be modified to include a circuit configured of a P-type transistor by varying a polarity of a voltage applied to a gate terminal. Similarly, a person of an ordinary skill in the art would such embodiments may be modified to include a circuit configured of a combination of a P-type transistor and an N-type transistor. A P-type transistor refers to a transistor in which an amount of current that is conducted when a voltage difference between a gate terminal and a source terminal increases in a negative direction increases. An N-type transistor refers to a transistor in which an amount of current that is conducted when a voltage difference between a gate terminal and a source terminal increases in a positive direction increases. The transistor may be one of various kinds such as a thin film transistor ("TFT"), a field effect transistor ("FET"), and a bipolar junction transistor ("BJT").

The first transistor T1 may be referred to as a driving transistor. A gate electrode of the first transistor T1 may be connected to a first electrode of the storage capacitor Cst, a first electrode of the first transistor T1 may be connected to the first power line ELVDDL, and a second electrode of the first transistor T1 may be connected to a second electrode of the storage capacitor Cst.

The second transistor T2 may be referred to as a scan transistor. A gate electrode of the second transistor T2 may be connected to an i-th scan line Si, a first electrode of the second transistor T2 may be connected to a j-th data line Dj, and a second electrode of the second transistor T2 may be connected to the gate electrode of the first transistor T1.

The light emitting diode LD may be an organic light emitting diode, an inorganic light emitting diode, a quantum dot light emitting diode, or the like. In an embodiment, an anode of the light emitting diode LD may be connected to the second electrode of the first transistor T1, and a cathode of the light emitting diode LD may be connected to the second power line ELVSSL. In an alternative embodiment, the anode of the light emitting diode LD may be connected to the first power line ELVDDL, and the cathode of the light emitting diode LD may be connected to the first electrode of the first transistor T1.

A first power voltage may be applied to the first power line ELVDDL, and a second power voltage may be applied to the second power line ELVSSL. The first power voltage may be greater than the second power voltage.

In an embodiment, when a scan signal of a turn-on level (here, a logic high level) is applied through the scan line Si, the second transistor T2 is turned on. When the second transistor T2 is turned on, the data voltage applied to the data line Dj is stored in the first electrode of the storage capacitor Cst.

Accordingly, a positive driving current, which corresponds to a voltage difference between the first electrode and the second electrode of the storage capacitor Cst, flows between the first electrode and the second electrode of the first transistor T1. Thus, the light emitting diode LD emits light with luminance corresponding to the data voltage. A current sensing value provided by the current sensor 15 may be a sum of driving current values flowing in all the pixels of the display portion 14. Since the data voltages are adjusted by the compensator 16 and the timing controller 11, the driving current values of the pixels may be adjusted.

In such an embodiment, when a scan signal of a turn-off level (here, a logic low level) is applied through the scan line Si, the second transistor T2 is turned off, and the data line Dj and the first electrode of the storage capacitor Cst are electrically separated. Therefore, even if the data voltage is applied to the data line Dj, the voltage is not charged in the first electrode of the storage capacitor Cst.

The pixel PXij illustrated in FIG. 1 may be a subpixel of one of red (R), green (G), and blue (B), or a unit pixel (or dot) including subpixels of red (R), green (G), and blue (B). In an embodiment, where the pixel PXij includes three different subpixels, a combination of light emitted from the subpixels included in the pixel PXij when the first pattern is displayed may be white light.

The pixel PXij illustrated in FIG. 3 is merely exemplary, and the pixels of alternative embodiments may further include other circuits. In one embodiment, for example, pixels having more complex circuits may further receive an emission control signal, so that an emission period may be adjusted.

Figure 4:
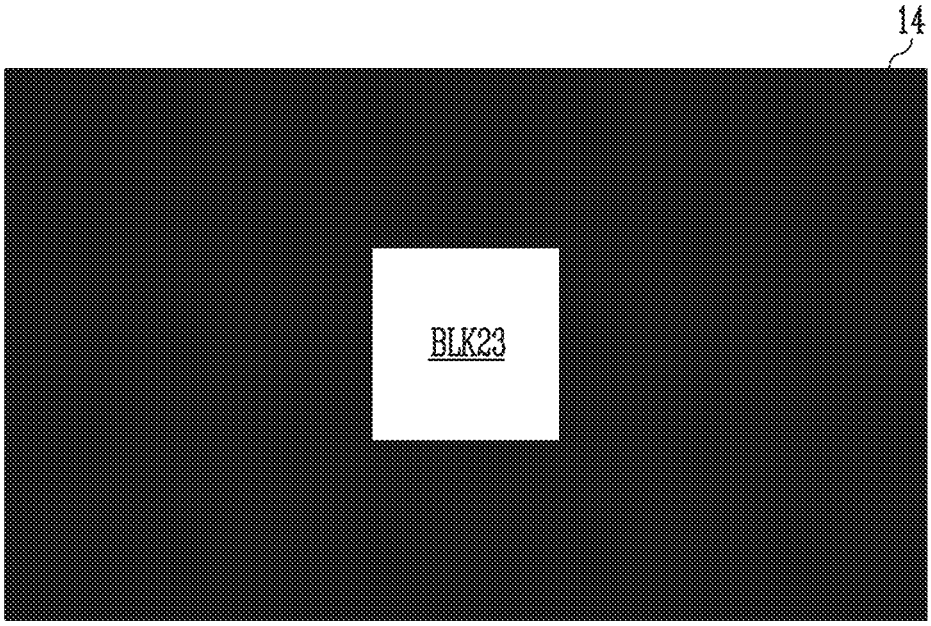
FIG. 4 illustrates an embodiment of a first pattern displayed in the display device illustrated in FIG. 1.
Figure 5:
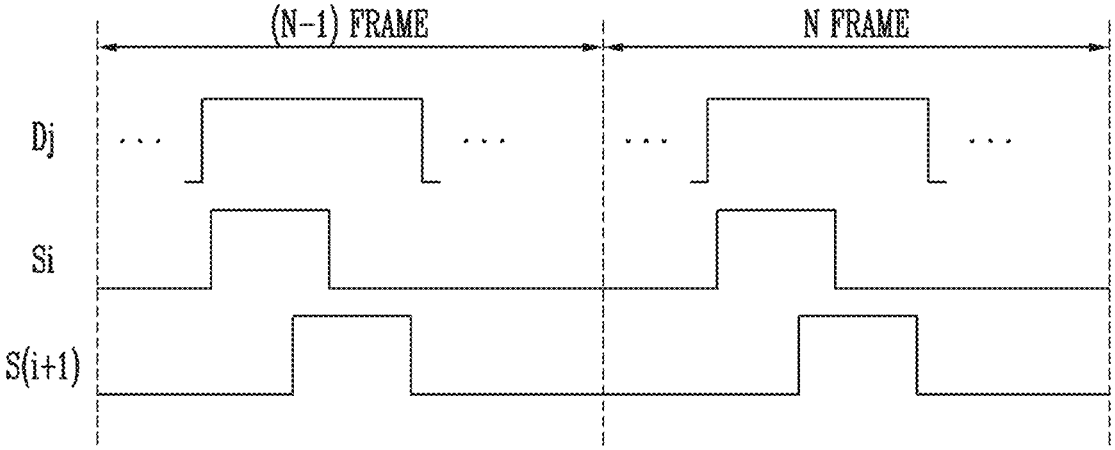
FIG. 5 illustrates a signal timing diagram of a pixel driving method according to an embodiment of the invention.

FIG. 4 illustrates an embodiment of a first pattern displayed in the display device 10 illustrated in FIG. 1, and FIG. 5 illustrates a signal timing diagram of a pixel driving method according to an embodiment of the invention.

In FIG. 4, the block BLK23 may correspond to the block BLK illustrated in FIG. 1, the block BLK23 may include the pixels (PXij, PX(i+1)j, PXi(j+1)) illustrated in FIG. 1.

Referring to FIG. 4, the first pattern may be a pattern displayed when the pixels (PXij, PX(i+1)j, PXi(j+1)) included in the specific block BLK23 of the display portion 14 emit light at the highest luminance or gray (white gray) and the pixels included in the remaining blocks do not emit light at the lowest luminance or gray (black gray). In an embodiment, where the number of blocks included in the display portion 14 is 100, the first pattern may mean a pattern displayed when the pixels (PXij, PX(i+1)j, PXi(j+1)) included in one specific block BLK23 among the 100 blocks emit light at the highest luminance or gray (white gray) and pixels included in each of the remaining 99 blocks included in each do not emit light. This first pattern may be referred to as a 1% full-white pattern.

In such an embodiment, where the number of blocks included in the display portion 14 is 100, when the first pattern is displayed on the display portion 14 included in the display device 10, the current flowing in the first power line ELVDDL may be a driving current of the pixels (PXij, PX(i+1)j, PXi(j+1)) that emit light at the highest gray (white gray) in the specific block BLK23.

Referring to FIG. 1, FIG. 4, and FIG. 5, in an (N−1)-th frame, when a turn-on level scan signal is supplied to an i-th scan line, a data voltage may be supplied to a j-th data line. In this case, the second transistor included in the pixel PXij is turned on, and the data voltage applied to the j-th data line is stored in the first electrode of the storage capacitor Cst included in the pixel PXij, and the light emitting diode LD included in the pixel PXij emits light by a driving current flowing between the first electrode and the second electrode of the first transistor T1 included in the pixel PXij.

In such an embodiment, in the (N−1)-th frame, a turn-on level scan signal may be supplied to an (i+1)-th scan line during a period in which the turn-on level scan signal is supplied to the i-th scan line. That is, the period in which the turn-on level scan signal is supplied to the i-th scan line and the period in which the turn-on level scan signal is supplied to the (i+1)-th scan line may overlap each other.

During the overlapping period, the data voltage supplied to the pixel PXij may be supplied to the pixel (PX(i+1)j), and the pixel (PX(i+1)j) may be pre-charged by the data voltage supplied to the pixel PXij.

When the scan signal of the turn-off level is supplied to the i-th scan line, the data voltage to be transmitted to the pixel (PX(i+1)j) is supplied to the j-th data line, and since the voltage is pre-charged in the capacitor Cst included in the pixel (PX(i+1)j), a time for charging the voltage in the capacitor Cst may be shortened, and the light emitting diode LD included in the pixel (PX(i+1)j) may emit light with a brightness corresponding to the data voltage.

In such an embodiment, as shown in FIG. 5, driving timing of the pixel (PX(i+1)j) and the pixel (PX(i+1)j) in an N-th frame may be the same as the driving timing of the pixel (PX(i+1)j) and the pixel (PX(i+1)j) in the (N−1)-th frame described above.

In such an embodiment, pixels included in the remaining blocks except for the specific block BLK23 among the blocks included in the display portion 14 may not emit light.

When the first pattern is displayed on the display device 10 according to an embodiment of the driving method as described above, even though a resolution is increased or a panel is enlarged, the data voltage may be sufficiently charged to a desired voltage (target voltage), and the pixels (PXij, PX(i+1)j, PXi(j+1)) may emit light at a luminance corresponding to the data voltage.

Figure 6:
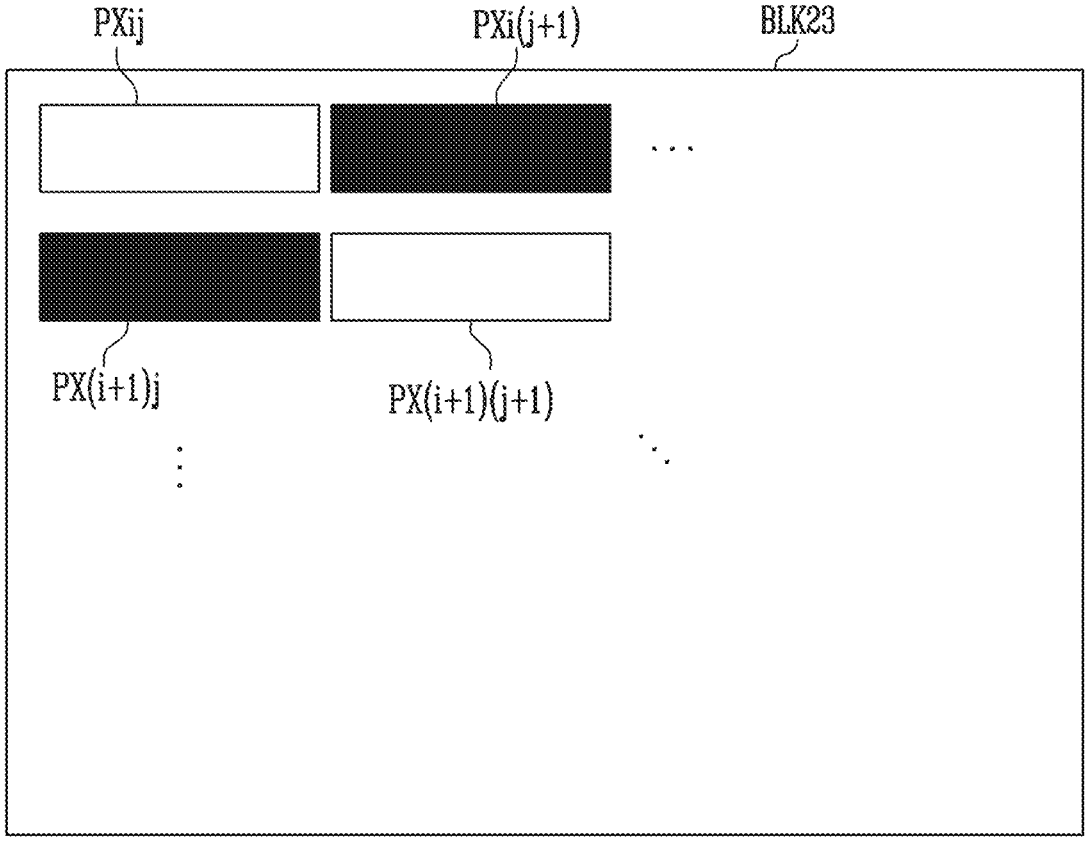
FIG. 6 illustrates an embodiment of a second pattern displayed in the display device illustrated in FIG. 1.
Figure 7:
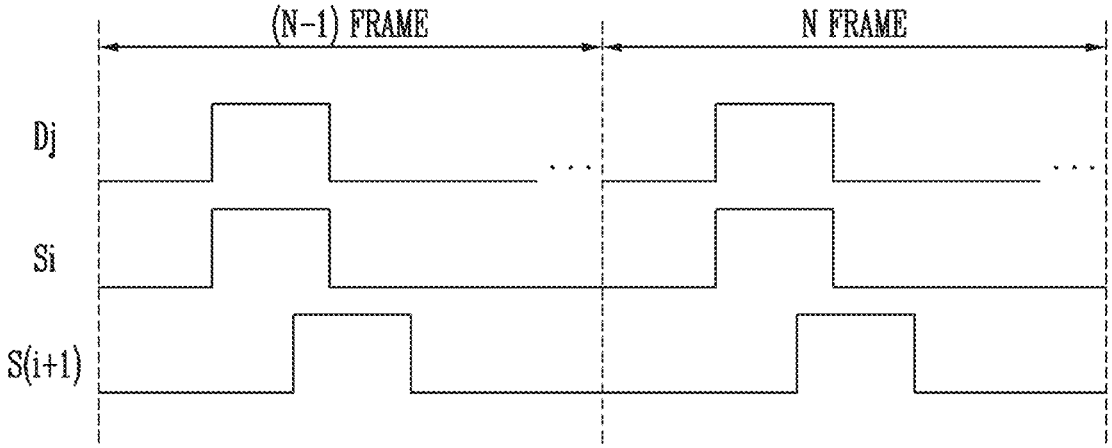
FIG. 7 illustrates a signal timing diagram of a pixel driving method according to an alternative embodiment of the invention.

FIG. 6 illustrates an embodiment of a second pattern displayed in the display device 10 illustrated in FIG. 1, and FIG. 7 illustrates a signal timing diagram of a pixel driving method according to an alternative embodiment of the invention.

In FIG. 6, the block BLK23 may correspond to the block BLK shown in FIG. 1.

Referring to FIG. 6, the second pattern may mean a regular pattern displayed when one pixel PXij included in the specific block BLK23 emits light at the highest luminance or gray (white gray), and other pixels (PX(i+1)j, PXi(j+1)) adjacent to the pixel PXij do not emit light, and another pixel PX (PX(i+1)(j+1)) adjacent to each of the other pixels (PX(i+1)j, PXi(j+1)) emits light at the highest luminance or gray (white gray). Such a second pattern may be referred to as a 1% checker pattern.

The luminance when the second pattern is displayed on the display device 10 may be lower than the luminance when the first pattern is displayed on the display device 10. In FIG. 6, since the number of the light emitting pixels is half of those in FIG. 4, the luminance when the second pattern is displayed on the display device 10 may correspond to half of the luminance when the first pattern is displayed on the display device 10.

The second pattern illustrated in FIG. 6 is merely exemplary, and the invention is not limited to that illustrated in FIG. 6. Alternatively, the second pattern may be a pattern displayed when one pixel PXij included in the specific block BLK23 does not emit light, and the other pixels (PX(i+1)j, PXi(j+1)) adjacent to one pixel PXij emit light at the highest gray (white gray).

In an embodiment, where the number of blocks included in the display portion 14 is 100, when the second pattern is displayed on the display portion 14 included in the display device 10, an amount of the current flowing in the first power line ELVDDL may be smaller than that of the current flowing in the first power line in the 1% full-white pattern described above. In an embodiment, an amount of the current when the second pattern is displayed on the display device 10 may be half an amount of the current when the first pattern is displayed on the display device 10.

Referring to FIG. 1, FIG. 6, and FIG. 7, in an (N−1)-th frame, when a turn-on level scan signal is supplied to an i-th scan line, a data voltage may be supplied to a j-th data line. In this case, the light emitting diode included in the pixel PXij may emit light in the same manner as described above with reference to FIG. 4 and FIG. 5.

In such an embodiment, as described above in the (N−1)-th frame, the period in which the turn-on level scan signal is supplied to the i-th scan line and the period in which the turn-on level scan signal is supplied to the (i+1)-th scan line may overlap each other.

During the overlapping period, the data voltage supplied to the pixel PXij may be supplied to the pixel (PX(i+1)j), and the pixel (PX(i+1)j) may be pre-charged by the data voltage supplied to the pixel PXij.

In such an embodiment, when a scan signal of a turn-off level is supplied to the i-th scan line, a data voltage corresponding to the lowest gray (black gray) may be supplied to the pixel (PX(i+1)j) through the j-th data line. In this case, since the voltage corresponding to the white gray is pre-charged in the capacitor Cst of the pixel (PX(i+1)j), a time for charging the data voltage of the black gray is longer than that of a case of not being pre-charged. Accordingly, the light emitting diode LD of the pixel (PX(i+1)j), which is desired not to emit light, may emit light at a predetermined luminance. Therefore, since a predetermined luminance may emit in the pixel (PX(i+1)j), a desired black gray may not be displayed on the display portion 14.

In such an embodiment, as shown in FIG. 7, driving timing of the pixel (PX(i+1)j) and the pixel (PX(i+1)j) in an N-th frame may be the same as the driving timing of the pixel (PX(i+1)j) and the pixel (PX(i+1)j) in the (N−1)-th frame described above.

Although not shown, in a case of the pixels (PXi(j+1)), PX(i+1)(j+1))) connected to the (j+1)-th data line, the light emitting diode LD of the pixel (PX(i+1)(j+1)) may emit light at a gray lower than the highest gray (white gray) since the voltage corresponding to the black gray is pre-charged in the capacitor Cst of the pixel (PX(i+1)(j+1)).

Therefore, the luminance when the second pattern is displayed on the display device 10 may be measured lower than half the luminance when the first pattern is displayed on the display device 10. In an embodiment, a lookup table shown in FIG. 8 may be used so that each pixel emits light at the predetermined or desired luminance when a resolution and a size of the panel are increased.

Figure 8:
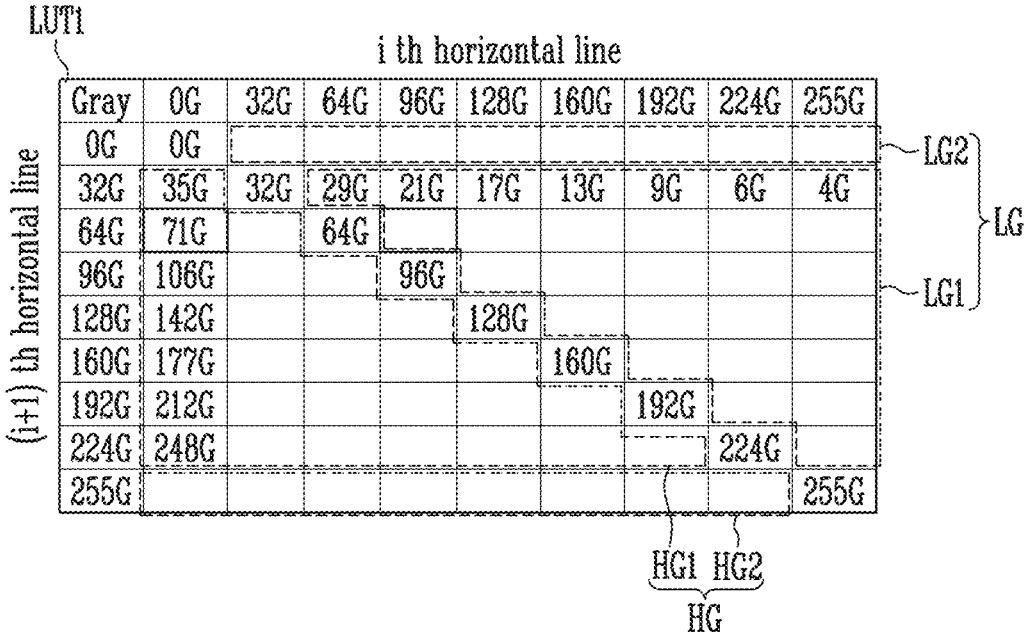
FIG. 8 illustrates a schematic view for explaining a problem occurring when setting a lookup table in which gray value-based compensation data is stored.

FIG. 8 illustrates a schematic view for explaining a problem occurring when setting a lookup table in which gray value-based compensation data is stored.

Referring to FIG. 8, a first lookup table LUT1 may mean one that store compensation data that compensates for the gray values of a current horizontal line (for example, the (i+1)-th horizontal line) based comparison of gray values of a previous horizontal line (for example, an i-th horizontal line) with gray values of the current horizontal line (for example, a (i+1)-th horizontal line). Here, the horizontal line may mean a line of pixels connected to a same scan line.

Gray values (0G-255G) in a vertical direction in the first lookup table LUT1 represent the gray values of the current horizontal line (for example, a (i+1)-th horizontal line), and gray values (0G-255G) in a horizontal direction in the first lookup table LUT1 represent the gray values of the previous horizontal line (for example, the i-th horizontal line).

The first lookup table LUT1 may include a low gray group LG and a high gray group HG.

Data included in each of the low gray group LG and the high gray group HG may be compensation data. The compensation data may be a gray value compensated as shown in FIG. 8, and as described below, the compensation data may correspond to a compensated value of a current flowing in the first power line ELVDDL, or a combination of gray values of each of three colors (RGB) for representing the gray values.

In the first lookup table LUT1, data not included in the low gray group LG and the high gray group HG are diagonally positioned. Such data corresponds to those of a case in which the gray value of the current horizontal line and the gray value of the previous horizontal line are the same as each other, and there is no change in the voltage level of the data voltage. Since the low gray group LG at an upper right of a diagonal direction corresponds to a case of falling from a high gray to a low gray, the low gray group LG corresponds to a falling edge at which voltage levels of the low gray group LG and the data voltage rises. Since the high gray group HG at a lower left of the diagonal direction corresponds to a case of rising from the low gray to the high gray, the high gray group HG corresponds to a rising edge at which the voltage level of the data voltage rises.

The compensator 16 may compensate an image data based on the first lookup table LUT1 in which the compensation data corresponding to the gray value of the previous horizontal line and the gray value of the current horizontal line are stored. In such an embodiment, intermediate values not in the first lookup table LUT1 may be determined by a interpolation method.

In one embodiment, for example, when the gray value of the current horizontal line is 32 gray and the gray value of the previous horizontal line is 32 gray, the compensation data may be determined as 32 gray.

In such an embodiment, when the gray value of the current horizontal line is 96 gray and the gray value of the previous horizontal line is 0 gray, the compensation data is determined as 106 gray. In an embodiment, where the driving transistor T1 is an N-type metal-oxide-semiconductor (NMOS) transistor, since the data voltage of the current horizontal line is higher than that of the previous horizontal line, the image data DATA' may be determined so that a higher data voltage is applied to the current horizontal line.

In such an embodiment, the low gray group LG may include a first low gray subgroup LG1 and a second low gray subgroup LG2. The first low gray subgroup LG1 refers to a group excluding the second low gray subgroup LG2 from the low gray group LG, and the second low gray subgroup LG2 may mean a group of compensation data in which the gray value of the current horizontal line is a lowest gray value (for example, 0 gray), and the gray values of the previous horizontal line correspond gray values greater than the lowest gray value (for example, 0 gray). Since the compensation data of the first lookup table LUT1 compensates the gray values of the current horizontal line by comparing the gray values of the current horizontal line to the gray values of the previous horizontal line, a gray value may not be changed to be smaller than the lowest gray value, in a case of the lowest gray value (for example, 0 gray) included in the second low gray subgroup LG2.

Meanwhile, the high gray group HG may include a first high gray subgroup HG1 and a second high gray subgroup HG2. The first high gray subgroup HG1 refers to a group excluding the second high gray subgroup HG2 from the high gray group HG, and the second high gray subgroup HG2 may mean a group of compensation data in which the gray value of the current horizontal line is a highest gray value (for example, 255 gray), and the gray values of the previous horizontal line correspond gray values smaller than the highest gray value (for example, 255 gray). Similar to the above, in a case of the highest gray value (for example, 255 gray) included in the second high gray subgroup HG2, a gray value may not be changed to be higher than the highest gray value.

Therefore, a lookup table that may compensate for the lowest and highest gray values may be desired. Hereinafter, an embodiment of a compensation method of the display device 10 using gray-luminance-current tables will be described with reference to FIG. 9 and FIG. 10.

Figure 9:
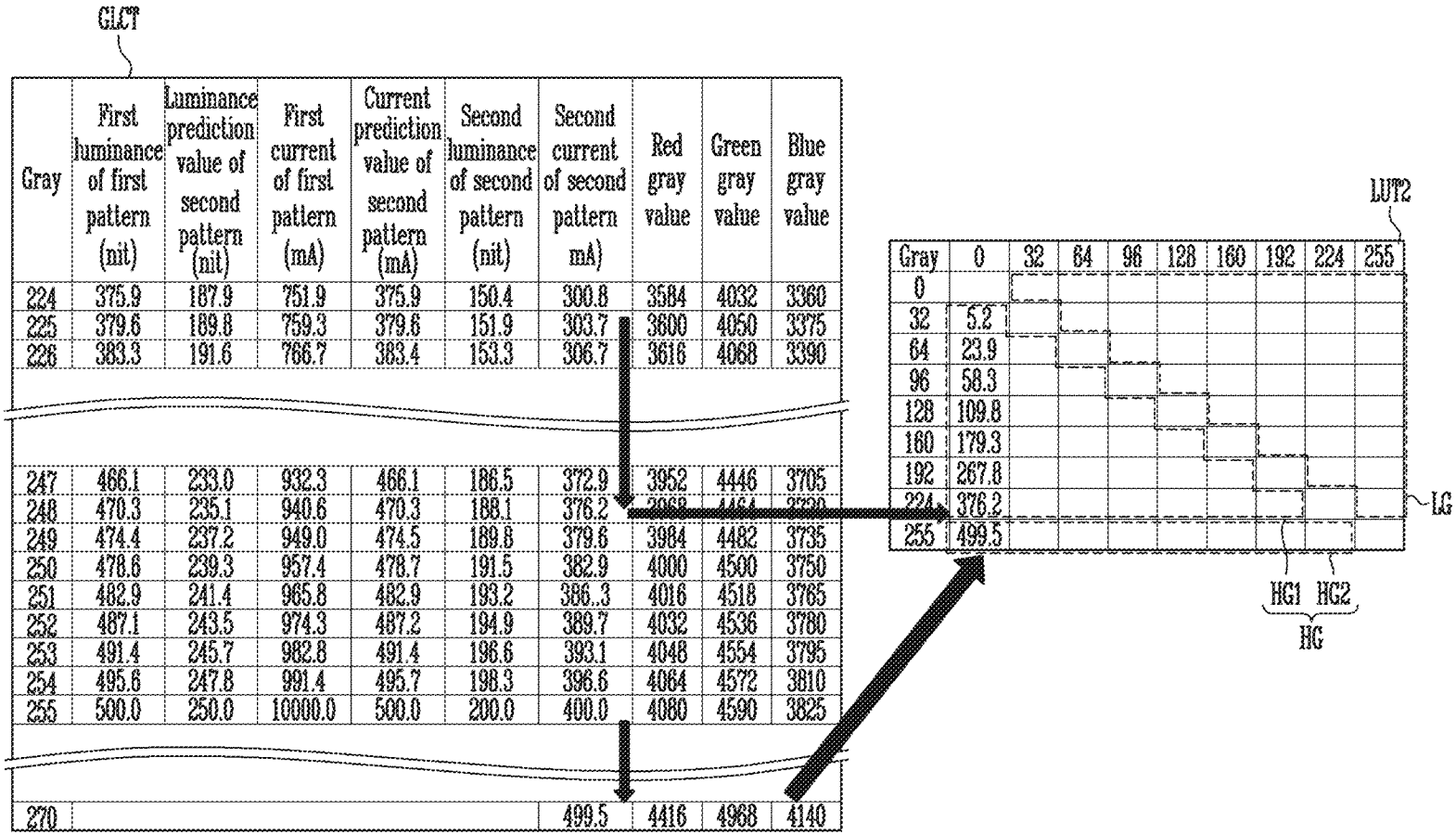
FIG. 9 illustrates a schematic view of a compensation method of a display device according to an embodiment of the invention.
Figures 11, 12:
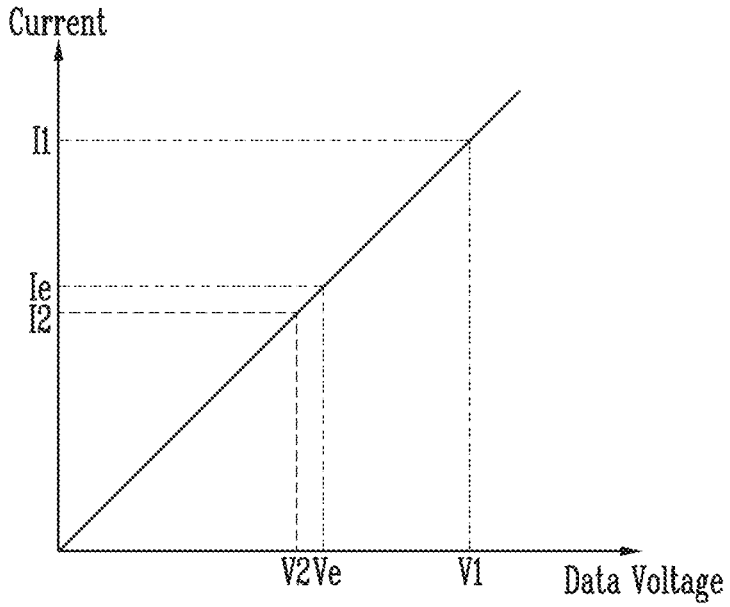
FIG. 11 illustrates a graph of a relationship between a data voltage corresponding to a gray value and a current flowing in a first power line.
FIG. 12 illustrates a schematic view of a compensation method of a display device according to an alternative embodiment of the invention.

FIG. 9 illustrates a schematic view of a compensation method of the display device 10 according to an embodiment of the invention, FIG. 10 illustrates a schematic view of a compensation method of the display device 10 according to an alternative embodiment of the invention, and FIG. 11 illustrates a graph of a relationship between a data voltage corresponding to a gray value and a current flowing in a first power line.

Referring to FIG. 9 and FIG. 10, an embodiment of a compensation method of the display device 10 according to the invention may mean a method of calculating compensation data by using characteristics when each of the first pattern and the second pattern is displayed on the display device 10, and of storing the calculated compensation data in a lookup table.

In an embodiment, the compensation method of the display device 10 may include sensing a first luminance of the display device 10 when the first pattern is displayed on the display device 10, and calculating a luminance prediction value based on the first luminance when the second pattern different from the first pattern is displayed on the display device 10. Here, the luminance of the display device 10 may be sensed by an image sensor (not shown) as described above.

Referring to FIG. 10, for example, when the first pattern of 224 gray is displayed on the display device 10, the first luminance of the display device 10 may be sensed to be 375.9 nit (or candela per square meter). In this case, a luminance prediction value corresponding to a case where the second pattern is displayed on the display device 10 may be calculated to be about 187.9 nit, which is half of the first luminance. That is, the first luminance may be greater than the luminance prediction value.

In an embodiment, the compensation method of the display device 10 may further include sensing a second luminance of the display device 10 when the second pattern is displayed on the display device 10.

Referring to FIG. 10, for example, when the second pattern of actual 224 gray is displayed on the display device 10, the second luminance of the display device 10 may be sensed to be about 150.4 nit. That is, the second luminance may be smaller than the luminance prediction value, and the first luminance may be larger than the second luminance and the luminance prediction value. In this case, as shown in FIG. 10, the current flowing in the first power line ELVDDL may be 300.8 milliampere (mA).

In such an embodiment, the compensation method of the display device 10 may further include adjusting the current flowing in the first power line of the display device 10 until the second luminance reaches the luminance prediction value.

Referring to FIG. 9, in one embodiment, since the second luminance is about 150.4 nit and the luminance prediction value is about 187.9 nit, the current flowing in the first power line ELVDDL may increase until the second luminance reaches the luminance prediction value. In this case, the current flowing in the first power line ELVDDL may be calculated through a gray-luminance-current table GLCT shown in FIG. 9. That is, referring to the gray-luminance-current table GLCT, since the luminance prediction value (about 187.9 nit) is very close to the second luminance (about 188.1 nit when the second pattern of 248 gray is displayed on the display device 10, the current flowing in the first power line ELVDDL may increase from 300.8 mA to 376.2 mA. Here, the current flowing in the first power line may be adjusted multiple times or repeatedly until the second luminance reaches the luminance prediction value.

Referring to FIG. 10, in one alternative embodiment, since the gray value for the first pixel (for example, PXij) in the second pattern of 224 gray is 224, until the second luminance (about 150.4 nit) reaches the luminance prediction value (about 187.9 nit), the gray value for the first pixel (for example, PXij) in the second pattern may increase from 224 to 248, and the current flowing in the first power line ELVDDL may also increase together as the gray value of the first pixel (for example, PXij) in the second pattern increases.

In an embodiment, the compensation method of the display device 10 may further include storing compensation data corresponding to a current when the second luminance reaches the luminance prediction value in a lookup table. Here, the compensation data may be a free emphasis value.

Referring to FIG. 9, in one embodiment, the current when the second luminance reaches the luminance prediction value is about 376.2 mA, which corresponds to a current measured when the second pattern of 248 gray is displayed on the display device 10. Therefore, the compensation data for 224 gray value of the current horizontal line at 0 gray value of the previous horizontal line is calculated as about 376.2 mA, which is a current measured when the second pattern of 248 gray is displayed on the display device 10 to be stored in the second lookup table LUT2. That is, the compensation data may be a current value (for example, about 376.2 mA) of a current corresponding to an increased gray value (for example, 248 gray increased in 224 gray). Although not shown, the compensation data may be the increased gray value (for example, 248 gray increased from 224 gray) instead of the current value of the current.

By performing the above-described operation on all the grays (0-255 gray), the second lookup table LUT2 may be finally set. That is, the compensation data included in the first high gray subgroup HG1 of the second lookup table LUT2 may be determined, and the compensation data included in the second high gray subgroup HG2 may also be determined. Although not shown, the compensation data included in the second low gray group LG2 of the second lookup table LUT2 may also be set in a similar manner as described above.

Here, the compensation data stored in the second lookup table LUT2 may be a current flowing in the first power line ELVDDL, but is not limited thereto, and may be an increased gray value as described above, and may be a combination of red, green, and blue gray values determined based on an accurate color capture ("ACC") block to realize a gray value.

The ACC block may gamma-correct the red, green, and blue gray values based on a preset correction gamma value based on gamma characteristics of the display device 10, thereby outputting the corrected red, green, and blue gray values.

The red gray value, the green gray value, and the blue gray value determined based on the ACC block may be implemented with, for example, 13 bits. In one embodiment, for example, the compensation data may be about 376.2 mA, which is a current measured when the second pattern of 248 gray for 224 gray values of the current horizontal line at 0 gray value of the previous horizontal line is displayed on the display device 10, the compensation data may be 248 gray, or the compensation data may be (3968, 4464, 3720), which is a combination of a red gray value, a green gray value, and a blue gray value.

As described above, according to an embodiment of the compensation method of the display device 10, compensation data may be calculated based on the luminance and the luminance prediction value of the display device 10.

In an embodiment, since the luminance of the display device 10 and the current flowing in the first power line ELVDDL correspond to each other, compensation data may be calculated using the current flowing in the first power line ELVDDL and a prediction value thereof.

In an alternative embodiment, the compensation method of the display device 10 may include sensing a first current flowing in the first power line ELVDDL of the display device 10 when the first pattern is displayed on the display device 10, and calculating a current prediction value based on the first current when the second pattern different from the first pattern is displayed on the display device 10. Here, the first current flowing in the first power line ELVDDL may be sensed by the current sensor 15 shown in FIG. 1.

Referring to FIG. 9, in one embodiment, when the first pattern of 224 gray is displayed on the display device 10, the first current may be sensed to be 751.9 mA. In this case, a current prediction value corresponding to a case where the second pattern is displayed on the display device 10 may be calculated to be about 375.9 [mA] corresponding to half of the first current. That is, the first current may be greater than the current prediction value.

In such an embodiment, the compensation method of the display device 10 may further include sensing a second current flowing in the first power line ELVDDL when the second pattern is displayed on the display device 10.

Referring to FIG. 10, in one alternative embodiment, when the second pattern of actual 224 gray is displayed on the display device 10, the second current of the display device 10 may be sensed to be about 300.8 mA. That is, the second current may be smaller than the current prediction value, and the first current may be larger than the second current and the current prediction value.

In such an embodiment, the compensating method of the display device 10 may further include adjusting the second current until the second current reaches the current prediction value.

Referring to FIG. 9, in one embodiment, since the second current is about 300.8 mA and the current prediction value is about 375.9 mA, the second current may continuously increase until the second current reaches the current prediction. In this case, the current flowing in the first power line ELVDDL may be calculated through a gray-luminance-current table GLCT shown in FIG. 9. That is, referring to the gray-luminance-current table GLCT, since the current prediction value (about 375.9 mA) is very close to the second current (about 376.2 mA when the second pattern of 248 gray is displayed on the display device 10, the second current flowing in the first power line ELVDDL may increase from about 300.8 mA to about 376.2 mA. Here, the second current flowing in the first power line may be adjusted multiple times or repeatedly until the second current reaches the current prediction value In such an embodiment, the compensation method of the display device 10 may further include storing compensation data corresponding to the second current when the second current reaches the current prediction value in a lookup table. Since the increased second current is about 376.2 mA, the compensation data for 224 gray value of the current horizontal line at 0 gray value of the previous horizontal line is calculated as about 376.2 mA, which is a current measured when the second pattern of 248 gray is displayed on the display device 10 to be stored in the second lookup table LUT2.

In an embodiment, as described above, the second current may also be increased by increasing the gray value for the first pixel (for example, PXij) in the second pattern. In this case, the compensation data may be an increased gray value (for example, 248 gray increased from 224 gray) with respect to the first pixel (for example, PXij).

By performing the above-described operation on all the grays (0-255 gray), the second lookup table LUT2 may be finally set. That is, the compensation data included in the first high gray subgroup HG1 of the second lookup table LUT2 may be determined, and the compensation data included in the second high gray subgroup HG2 may also be determined. In such an embodiment, although not shown, the compensation data included in the second low gray group LG of the second lookup table LUT2 may also be set in a similar manner as described above.

In an embodiment, the compensation data for the highest gray (white gray or 255 gray) and compensation data for the lowest gray (black gray or 0 gray) may be determined similarly to those shown in FIG. 9, and the remaining compensation data may be determined in the same manner as the compensation data shown in FIG. 8.

Referring to FIG. 10, in one alternative embodiment, compensation data included in a second high gray subgroup HG2 of a third lookup table LUT3 may be determined as described with reference to FIG. 9. In this case, the compensation data included in the second high gray subgroup HG2 may be expressed in gray. However, the invention is not limited thereto. Although not shown, compensation data included in a second low gray subgroup LG2 of the third lookup table LUT3 may also be set smaller than 0 gray similarly to the above.

In an embodiment, when a voltage-current curve defining a relationship between the data voltage to be provided to the display portion 14 and the current flowing in the first power line ELVDDL is set in advance according to the image data DATA', the compensation data may be calculated based on the above-mentioned voltage-current curve.

Referring to FIG. 11, in one embodiment, when the first pattern is displayed on the display device 10 by a first data voltage V1 and a first current 11, a prediction data voltage Ve when the second pattern is displayed on the display device 10. The prediction data voltage Ve may be calculated to be smaller than the first data voltage V1, and a prediction current 12 (or current prediction value) when the second pattern is displayed on the display device 10 may also be calculated to be smaller than the first current 11. In such an embodiment, when each of the second data voltage V2 and the second current 12 measured when the second pattern is displayed on the display device 10 is smaller than the prediction data voltage Ve and the prediction current 12, the second current 12 may be increased to be the same as the prediction current 12. As the second current 12 is increased, the second data voltage V2 may also have the same value as the prediction data voltage Ve.

In an embodiment, as described above, the compensation method of the display device 10 may effectively calculate the compensation data by compensating for the highest gray (white gray) and the lowest gray (black gray).

In an embodiment, the compensation method of the display device 10 may provide effectively compensate for all the grays by more precisely setting the lookup table in which the compensation data is stored.

In an embodiment, as described above, since luminous efficiencies of respective display devices may different from each other, it is desired to calculate the compensation data based on the luminous efficiency of the display portion 14. Hereinafter, a compensation method of the display device 10 according to an alternative embodiment will be described with reference to a table shown in FIG. 12.

FIG. 12 illustrates a schematic view of a compensation method of a display device according to an alternative embodiment of the invention.

Referring to FIG. 12, an embodiment of the compensation method of the display device 10 may calculate compensation data of a target display device to set a lookup table using first reference data voltages Vref_1 and second reference data voltages Vref_2 of a reference display device having a reference emission efficiency Eref, for case where respective display devices have different light emission efficiencies E11, E12, E13, E21, E22, and E23 from each other.

Here, the target display device may be substantially the same as the display device 10 illustrated in FIG. 1. Therefore, any repetitive detailed description of the target display device will be omitted.

In an embodiment, the compensation method of the display device 10 may include storing the first reference data voltages Vref_1 for pixels of the reference display device when the first pattern is displayed on the reference display device at the first luminance; storing the second reference data voltages Vref_2 for the pixels of the reference display device when the second pattern different from the first pattern is displayed on the reference display device at the second luminance; and storing the first data voltages V11_1, V12_1, V13_1, V21_1, V22_1, and V23_1 for pixels of the target display device when the first pattern is displayed on the target display device at the first luminance.

Here, the first pattern may be the same as the pattern described above with reference to FIG. 5 and FIG. 6. In one embodiment, for example, the first pattern of the first luminance may be a 1% full-white pattern of 500 nit. However, the invention is not limited thereto.

Here, the second reference data voltages Vref_2 may be greater than the first reference data voltages Vref_1.

In such an embodiment, the first data voltages V11_1, V12_1, V13_1, V21_1, V22_1, and V23_1 may be calculated by using the reference emission efficiency Eref of the reference display device, the first reference data voltages Vref_1 and the emission efficiency (one of E11, E12, E13, E21, E22, and E23) of the target display device.

In one embodiment, for example, the first data voltage V13_1 of the target display device having the light emission efficiency of E13 may be calculated by Equation 1 below.

$$V13_1 = V\,ref_1 + \alpha(E\,ref - E13) \quad \text{[Equation 1]}$$

In Equation 1, Vref_1 denotes a first reference data voltage, a denotes a preset parameter, Eref denotes a reference emission efficiency, and α(Eref-E13) denotes an offset value.

Similar to the above, each of the first data voltages V11_1, V12_1, V13_1, V21_1, V22_1, and V23_1 included in the table illustrated in FIG. 12 may be calculated.

In such an embodiment, the compensation method of the display device 10 may further include calculating second data voltages V11_2, V12_2, V13_2, V21_2, V22_2, and V23_2 for the pixels of the target display device based on a ratio of the first data voltages V11_1, V12_1, V13_1, V21_1, V22_1, and V23_1 with respect to the first reference data voltages Vref_1 when the second pattern is displayed on the target display device at the second luminance.

Here, the second pattern may be the same as the pattern described above with reference to FIG. 7 and FIG. 9. The second luminance may be lower than the first luminance. In one embodiment, for example, the second pattern of the second luminance may be a 1% checker pattern of 250 nit. However, the invention is not limited thereto.

In such an embodiment, the second data voltages V11_2, V12_2, V13_2, V21_2, V22_2, and V23_2 may be calculated based on: the first data voltages V11_1, V12_1, V13_1, V21_1, V22_1, and V23_1; a difference value (or reference compensation amount Vref_3) between the first reference data voltages Vref_1 and the second reference data voltages Vref_2; and a ratio of the first data voltages V11_1, V12_1, V13_1, V21_1, V22_1, V23_1 with respect to the first reference data voltages Vref_1.

In one embodiment, for example, the second data voltage V13_2 of the target display device having the light emission efficiency of E13 may be calculated by Equation 2 below.

$$V13_2 = V13_1 + (Vref_2 - Vref_1) \times \left(\frac{V13_1}{Vref_1}\right) \quad \text{[Equation 2]}$$

In such an embodiment, the compensation method of the display device may further include storing compensation data corresponding to the second data voltages in the lookup table.

In an embodiment, the compensation data may be equal to the second data voltages V11_2, V12_2, V13_2, V21_2, V22_2, and V23_2.

In an alternative embodiment, the compensation data may be equal to compensation amounts V11_3, V12_3, V13_3, V21_3, V22_3, and V23_3.

Here, the compensation amounts V11_3, V12_3, V13_3, V21_3, V22_3, and V23_3 may be, for example, difference values between the first data voltages V11_1, V12_1, V13_1, V21_1, V22_1, and V23_1 and the second data voltages V11_2, V12_2, V13_2, V21_2, V22_2, and V23_2.

In an embodiment, the compensation amounts V11_3, V12_3, V13_3, V21_3, V22_3, and V23_3 may be calculated based on a ratio of the first data voltages V11_1, V12_1, V13_1, V21_1, V22_1, and V23_1 to the first reference data voltages Vref_1 and a reference compensation amount (Vref_3). In one embodiment, For example, the compensation amount V13_3 of the target display device having the emission efficiency of E13 may be calculated by Equation 3 below.

$$V13_3 = Vref_3 \times \left(\frac{V13_1}{Vref_1}\right) \quad \text{[Equation 3]}$$

In an alternative embodiment, the compensation data may be a gray value of each of the second data voltages V11_2, V12_2, V13_2, V21_2, V22_2, V23_2 and/or of the compensation amounts V11_3, V12_3, V13_3, V21_3, and V22_3, V23_3, a value of the current, a combination of the grays of the three colors by the accurate color capture block, or the like.

In an embodiment, as described above, the compensation method of the display device may effectively calculate compensation data and set a lookup table by using information about an emission efficiency of the display device.

In such an embodiment, the method of compensating the display device may effectively compensate for the highest gray and the lowest gray by using information on the emission efficiency of the display device.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and detail may be made therein without departing from the spirit and scope of the present disclosure as defined by the following claims.

What is claimed is:

1. A compensation method of a display device, comprising:

sensing a first luminance of the display device when a first pattern is displayed on the display device;

calculating a luminance prediction value corresponding to a second pattern to be displayed on the display device based on the first luminance, wherein the second pattern is different from the first pattern;

sensing a second luminance of the display device when the second pattern is displayed on the display device;

adjusting a current flowing in a first power line of the display device until the second luminance reaches the luminance prediction value; and storing compensation data corresponding to an adjusted current in a lookup table when the second luminance reaches the luminance prediction value.

2. The compensation method of the display device of claim 1, wherein the first luminance is greater than the second luminance and the luminance prediction value, and the adjusting the current includes increasing the current until the second luminance reaches the luminance prediction value.

3. The compensation method of the display device of claim 2, wherein the display device includes a first pixel connected to the first power line, a second power line, a first data line and a first scan line, and a second pixel connected to the first power line, the second power line, the first data line and a second scan line, the first pixel includes a first light emitting diode connected between the first power line and the second power line, the second pixel includes a second light emitting diode connected between the first power line and the second power line, the first pattern is a pattern displayed when both the first light emitting diode and the second light emitting diode emit light, and the second pattern is a pattern displayed when the first light emitting diode emits light and the second light emitting diode does not emit light.

4. The compensation method of the display device of claim 3, wherein the first power line of the first pixel and the first power line of the second pixel are connected to each other at a same node.

5. The compensation method of the display device of claim 3, wherein when at least one of the first pattern and the second pattern is displayed, a period during which a turn-on level scan signal is supplied to the first scan line and a period during which a turn-on level scan signal are supplied to the second scan line partially overlap each other.

6. The compensation method of the display device of claim 3, wherein the first pixel includes three subpixels of different colors.

7. The compensation method of the display device of claim 6, wherein a combination of light emitted from the three subpixels in the first pattern is white light.

8. The compensation method of the display device of claim 3, wherein the adjusting the current includes increasing the current by increasing a gray value for the first pixel in the second pattern until the second luminance reaches the luminance prediction value.

9. The compensation method of the display device of claim 8, wherein the compensation data stored in the lookup table is an increased gray value with respect to the first pixel.

10. The compensation method of the display device of claim 9, wherein the compensation data stored in the lookup table is a current value of the current corresponding to the increased gray value.

11. A compensation method of a display device, comprising:

sensing a first current flowing in a first power line of the display device when a first pattern is displayed on the display device;

calculating a current prediction value corresponding to a second pattern to be displayed on the display device based on the first current, wherein the second pattern is different from the first pattern;

sensing a second current flowing in the first power line when the second pattern is displayed on the display device;

adjusting the second current until the second current reaches the current prediction value; and storing compensation data corresponding to an adjusted second current in a lookup table when the second current reaches the current prediction value.

12. The compensation method of the display device of claim 11, wherein an amount of the first current is larger than an amount of the second current and the current prediction value; and the adjusting the second current includes increasing the second current until the second current reaches the current prediction value.

13. The compensation method of the display device of claim 12, wherein the display device includes a first pixel connected to the first power line, a second power line, a first data line, and a first scan line, and a second pixel connected to the first power line, the second power line, the first data line, and a second scan line, the first pixel includes a first light emitting diode connected between the first power line and the second power line, the second pixel includes a second light emitting diode connected between the first power line and the second power line, the first pattern is a pattern displayed when both the first light emitting diode and the second light emitting diode emit light, and the second pattern is a pattern displayed when the first light emitting diode emits light and the second light emitting diode does not emit light.

14. The compensation method of the display device of claim 13, wherein the first power line of the first pixel and the first power line of the second pixel are connected to each other at a same node.

15. The compensation method of the display device of claim 13, wherein when at least one of the first pattern and the second pattern is displayed, a period during which a turn-on level scan signal is supplied to the first scan line and a period during which a turn-on level scan signal are supplied to the second scan line partially overlap each other.

16. The compensation method of the display device of claim 13, wherein the first pixel includes three subpixels of different colors.

17. The compensation method of the display device of claim 16, wherein a combination of light emitted from the three subpixels in the first pattern is white light.

18. The compensation method of the display device of claim 13, wherein the adjusting the second current includes increasing the second current by increasing a gray value for the first pixel in the second pattern until the second current reaches the current prediction value.

19. The compensation method of the display device of claim 18, wherein the compensation data stored in the lookup table is an increased gray value with respect to the first pixel.

20. The compensation method of the display device of claim 19, wherein the compensation data stored in the lookup table is a current value of the second current corresponding to the increased gray value.

21. A compensation method of a display device, comprising:

storing first reference data voltages for pixels of a reference display device when a first pattern is displayed on the reference display device at a first luminance;

storing second reference data voltages for the pixels of the reference display device when a second pattern, which is different from the first pattern, is displayed on the reference display device at a second luminance;

storing first data voltages for pixels of the display device when the first pattern is displayed on the display device at the first luminance;

calculating second data voltages to be provided to the pixels of the display device based on a ratio of the first data voltages with respect to the first reference data voltages when the second pattern is displayed on the display device at the second luminance; and storing compensation data corresponding to the second data voltages in a lookup table.

22. The compensation method of the display device of claim 21, wherein the display device includes a first pixel connected to a first power line, a second power line, a first data line, and a first scan line, and a second pixel connected to the first power line, the second power line, the first data line, and the second scan line, the first pixel includes a first light emitting diode connected between the first power line and the second power line, the second pixel includes a second light emitting diode connected between the first power line and the second power line, the first pattern is a pattern displayed when both the first light emitting diode and the second light emitting diode emit light, and the second pattern is a pattern displayed when the first light emitting diode emits light and the second light emitting diode does not emit light.

23. The compensation method of the display device of claim 21, wherein the second data voltages are calculated based on a difference value between the first reference data voltages and the second reference data voltages, and the ratio of the first data voltages with respect to the first reference data voltages.

24. The compensation method of the display device of claim 23, wherein the first luminance is greater than the second luminance, and the second reference data voltages are greater than the first reference data voltages.

* * * * *